United States Patent [19]

Braytenbah et al.

[11] 4,015,430

[45] Apr. 5, 1977

[54] ELECTRIC POWER PLANT AND TURBINE ACCELERATION CONTROL SYSTEM FOR USE THEREIN

[75] Inventors: Andrew S. Braytenbah, Pennsauken, N.J.; Karl O. Jaegtnes, Chester, Pa.

[73] Assignee: Westinghouse Electric Corporation, Pittsburgh, Pa.

[22] Filed: Sept. 30, 1975

[21] Appl. No.: 618,098

[52] U.S. Cl. ..... 60/644; 415/17; 415/30; 60/663; 60/679

[51] Int. Cl.[2] ..... F01K 13/02

[58] Field of Search ..... 415/30, 17; 60/660, 60/662, 663, 679, 644

[56] References Cited

UNITED STATES PATENTS 3,488,961 1/1970 Gerber ..... 60/662

*Primary Examiner*—Allen M. Ostrager
*Attorney, Agent, or Firm*—E. F. Possessky

[57] ABSTRACT

An electric power plant having dual turbine-generators and a steam source which includes a high temperature gas-cooled nuclear reactor. Each turbine includes a high pressure portion driven by superheat steam and a lower pressure portion driven by reheat steam. A turbine bypass system permits minimum flows of superheat and reheat steam from the source at times when the turbines require flows of such steam that are less than the minimum flows. Before it is reheated, steam that has passed through the high pressure portions and their bypass lines drives auxiliary steam turbines that rotate means for propelling the coolant gas through the reactor. During acceleration of a turbine-generator to its synchronous speed, one of the steam flows through its high and lower pressure portions is varied to govern the shaft speed, while the other flow is held relatively constant, that one of the flows which is varied being determined by the shaft speed. As the turbine-generator is accelerated, the steam flow through a bypass line associated with its lower pressure portion is varied to compensate changes of flow through that portion, in order to maintain a desired pressure of hot reheat steam.

26 Claims, 9 Drawing Figures

ELECTRIC POWER PLANT AND TURBINE ACCELERATION CONTROL SYSTEM FOR USE THEREIN

CROSS REFERENCES TO RELATED APPLICATIONS

Reference is made to the following previously filed and copending applications assigned to the present assignee.

"HTGR Power Plant Hot Reheat Steam Pressure Control System", Ser. No. 463,027, now U.S. Pat. No. 3,894,394, filed on Apr. 22, 1974 by Andrew S. Braytenbah and Karl O. Jaegtnes;

"HTGR Power Plant Turbine-Generator Load Control System", Ser. No. 464,027, filed on Apr. 25, 1974 by Andrew S. Braytenbah and Karl O. Jaegtnes;

"Load Control System Especially Adapted for HTGR Power Plant Turbine", Ser. No. 497,608, filed on Aug. 15, 1974 by Ola J. Aanstad;

"Acceleration Control Arrangement for Turbine System, Especially for HTGR Power Plant", Ser. No. 519,703, now U.S. Pat. No. 3,939,660, filed on Oct. 31, 1974 by Ola J. Aanstad; and "Dual Turbine Power Plant and Method of Operating Such Plant, Especially One Having an HTGR Steam Supply", Ser. No. 571,145, filed on Apr. 24, 1975 by Andrew S. Braytenbah and Karl O. Jaegtnes.

BACKGROUND OF THE INVENTION

In a dual turbine electric power plant, each of two steam turbines independently uses steam from a common steam supply to drive an associated electric generator. A dual turbine electric power plant offers an advantage that a malfunction of a turbine component or of its associated steam lines, control valves, and condensor may necessitate shutting down one, but not both of the turbine-generators, with the result that up to 50% of the total plant power output may be generated during such a shutdown. In a single turbine electric power plant, such a malfunction may necessitate shutting down the total generating capacity until necessary repairs are made.

When an electric power plant, whether single or dual turbine, includes a high temperature gas-cooled nuclear reactor in the steam supply, a superheat section of a steam generator supplies superheat steam to a high pressure portion of a turbine, while a reheat section of the steam generator furnishes reheat steam to a corresponding lower pressure portion of the turbine. Generally, the superheat steam improves the efficiency at which a turbine-generator converts steam energy to electrical energy. For purposes of protecting the steam generator from low steam flow through its superheat and reheat sections, a bypass line is connected across each turbine portion to permit a desired minimum steam flow through a section at times when the total flow of steam from that section through the turbine portions is less than the desired minimum.

In one type of power plant having a steam supply which includes a high temperature gas cooled nuclear reactor, auxiliary steam turbines are connected in the steam path which conducts steam, after its passage through the high pressure turbine portions and their associated bypass lines, to the inlet of the reheat section. The auxiliary steam turbines drive means for circulating the coolant gas through the reactor and the steam generator. At times when steam flows through the bypass lines associated with the lower pressure turbine portions, it is desirable to control the pressure of steam at the outlet of the reheater section, for such control improves control of the speed of the gas circulating means, and thus control of the flow rate of the coolant gas through the nuclear reactor.

An important aspect of the operation of a turbine-generator involves acceleration of the generator to synchronous speed, at which speed the generator may be connected to an associated power network. Prior to commencing such acceleration, the turbine-generator is rotated by a turning motor, typically at a few revolutions per minute, while the turbine portions are warmed by a gentle flow of steam. When acceleration commences, the turbine-generator is disconnected from the turning motor, and the shaft speed is controlled by governing the flow of steam through the turbine portions. Generally, the shaft speed is increased from turning gear speed to synchronous speed is increased from turning gear speed to synchronous speed at such a rate that no turbine part is subjected to harmful thermal conditions.

When a turbine-generator uses steam from a source that includes a high temperature gas-cooled nuclear reactor and auxiliary steam turbines are connected to drive the coolant gas circulators as above described, the presence of the auxiliary turbines necessitates that steam from the reheat section as well as the superheat section is at an elevated pressure when acceleration commences. Because of the elevated pressure of the steam emerging from the reheat section, acceleration of the turbine-generator cannot be controlled simply by fully opening the flow control valve to the inlet of the lower pressure portion while attempting to control the shaft speed by positioning the flow control valve to the inlet of the high pressure portion; rather, each of the steam flows through the high pressure turbine portion and the corresponding lower pressure portion must be controlled during acceleration. At the same time the pressure of steam at the outlet of the reheater section should be regulated according to its desired value.

In a proposed system for controlling the acceleration of a turbine-generator in a single turbine power plant wherein the steam supply includes a high temperature nuclear reactor cooled by a gas that is circulated by the above described auxiliary steam turbine, a controller for governing the pressure of steam emerging from the reheat section includes both proportional and integral modes. In a dual turbine plant, operation of two such controllers in concert may cause imbalances between the steam flows through the bypass lines associated with the lower pressure turbine portions. The proposed system permits a flow of steam through a lower pressure turbine portion by opening a two-position valve, which flow may vary, depending upon the flow characteristics of the valve and the turbine portion, which typically are temperature dependent. Such variation may affect the shaft speed, which is controlled by the steam flow through a high pressure turbine portion.

There appears to be a need for an acceleration control system for a turbine generator connected to a steam supply system such that each of first and second steam flows through portions of the turbine must be controlled during acceleration, the control system desirably varying only one of the steam flows for purposes of governing the shaft speed, while the other flow is held relatively constant. Such a control system is advantageously applicable to both single and dual turbine plants. Further desirably, such a system selects that one of the steam flows which is varied for speed control purposes according to the speed range within which the turbine-generator is operating. When more than one valve may be positioned to vary a steam flow for speed control purposes, that control valve which is used is selected to match advantageously the flow control characteristics of the valve to the range of speeds that it must govern. Especially in a power plant having a high temperature gas-cooled reactor in its steam supply system, the control system additionally desirably varies the flow of steam through the bypass line associated with the lower pressure turbine portion to regulate the pressure of steam at the outlet of the reheat section according to its desired value. Such pressure regulation improves the above-mentioned control of the speed of the coolant gas circulators, increases the accuracy of control of the shaft speed, and assures a desired minimum passage of steam through the reheat section.

The description of prior art herein is made on good faith and no representation is made that any prior art considered is the best pertaining prior art nor that the interpretation placed on it is unrebuttable.

SUMMARY OF THE INVENTION

In accordance with the present invention, an electric power plant includes a turbine-generator comprising a high pressure turbine portion driven by superheat steam and a lower pressure turbine portion driven by reheat steam, the turbine portions being shaft coupled to drive an electric generating means. Motive steam for the turbine-generator is supplied by a steam generator which has a superheat section for generating superheat steam and a reheat section for reheating steam. Superheat steam which does not drive the high pressure portion may flow through a bypass means directly to the steam exhaust of the high pressure portion. Steam that is exhausted by the high pressure portion as well as steam that has passed through its bypass means is reheated in the reheat section. From the reheat section steam may flow through the lower pressure portion to its steam exhaust and through a bypass means directly to such steam exhaust. The shaft speed of the turbine-generator is detected and compared with a desired shaft speed. In response to a difference between the detected and desired speed values, one of the steam flows through the high and lower pressure turbine portions is varied to reduce the difference, in order to control the detected speed according to the desired value, while the other turbine steam flow is held relatively constant.

DESCRIPTION OF THE PREFERRED EMBODIMENT

Figure 1:
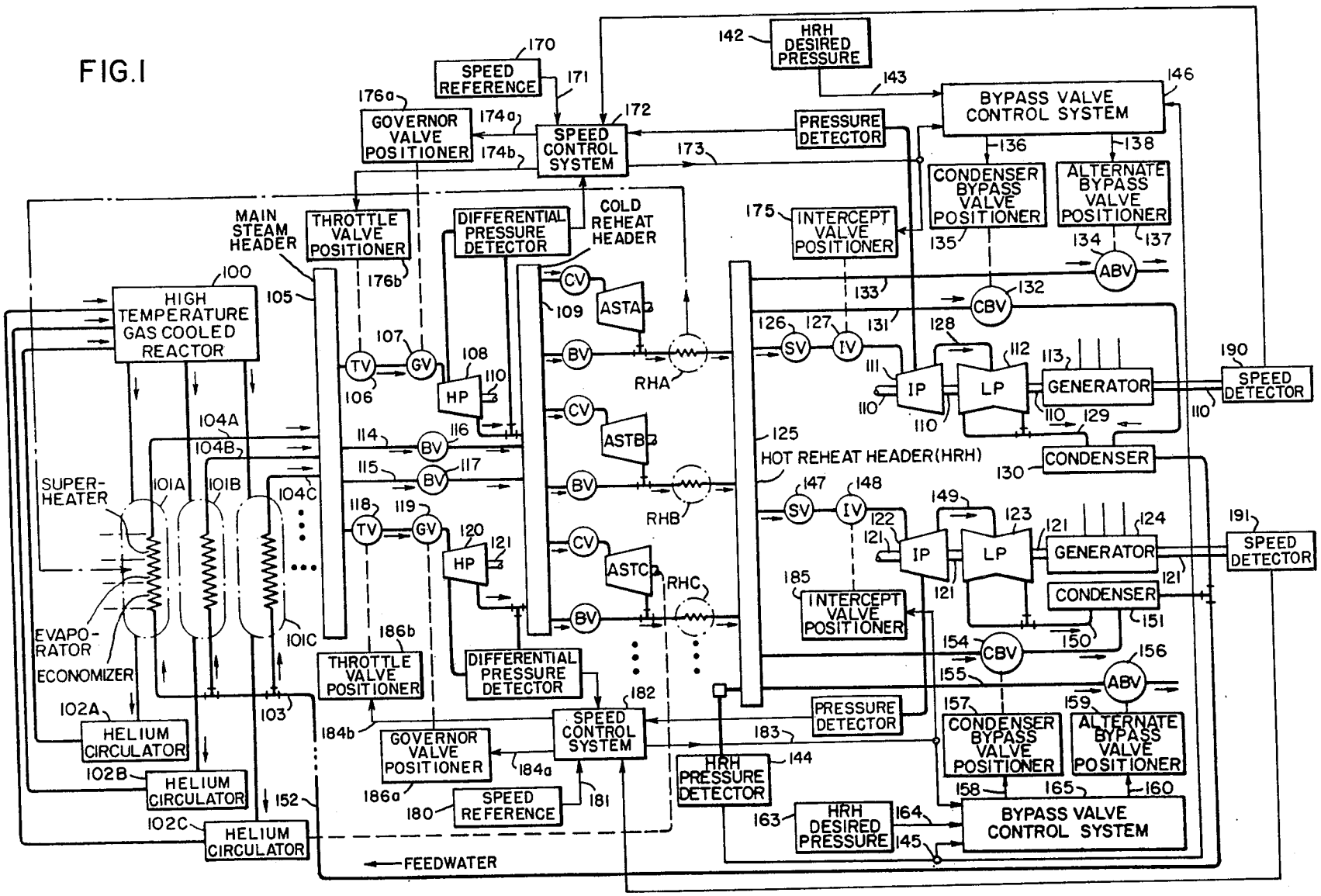
FIG. 1 schematically illustrates an electric power plant according to the present invention.

Referring to FIG. 1 each of three helium circulators circulates helium coolant gas through a high temperature gas cooled reactor 100 and an associated steam generator. The steam generators 101A, 101B and 101C are associated with the helium circulators 102A, 102B and 102C respectively. Hot coolant gas is discharged from the reactor 100 and transports reactor-generated heat to each of the three steam generators. A steam generator derives heat from the reactor coolant gas flowing through it, to generate superheated and reheated steam. Feedwater is supplied to each of the steam generators through the line 103, and passes through economizer, evaporator and superheater sections in each steam generator. Superheated steam is discharged from the steam generators through the lines 104A, 104B and 104C, which conduct the superheated steam to a main steam header 105. Each steam generator also incorporates a reheater section, and utilizes reactor-generated heat to reheat a flow of steam through the incorporated reheater section. A dashed line illustrates the incorporation of a reheater section RHA in the steam generator 101A. Reheaters RHB and RHC similarly are incorporated in the steam generators 101B and 101C. Cold reactor coolant gas is discharged from a steam generator and pumped back through the reactor 100 by the associated helium circulator. It is understood that a typical HTGR power plant may employ a number different than three steam generators and associated helium circulators, depending upon the thermal generating capacity of the reactor 100. Additional steam generators would be connected to receive feedwater through the line 103 and to discharge superheated steam to the main steam header 105.

From the main steam header 105 steam may flow through a throttle valve 106 and a governor valve 107 to the inlet of a high pressure turbine 108. Exhaust steam from the high pressure turbine 108 is discharged to a cold reheat header 109. The high pressure turbine 108 turns on a shaft 110 with an intermediate pressure turbine 111, a low pressure turbine 112 and a generator 113, hereafter referred to as the "A" turbine-generator. Bypass lines 114 and 115 are connected between the main steam header 105 and the cold reheat header 109, and bypass valves 116 and 117 are connected to govern the steam flows through the lines 114 and 115 respectively. Steam also may flow from the main steam header 109 through a throttle valve 118, a governor valve 119, and a high pressure turbine 120, to the cold reheat header 109. The high pressure turbine 120 turns on a shaft 121 with an intermediate pressure turbine 122, a low pressure turbine 123, and a generator 124, hereafter referred to as the "B" turbine-generator. For most desirable steam generator operation, the steam flow through the superheater sections must be maintained at a level which is at least equal to a desired minimum steam flow. When the combined steam flow through the turbines 108 and 120 is less than the desired minimum, the bypass valves 116 and 117 are positioned to maintain the desired minimum steam flow through the superheater sections. At times when the combined steam flow through the turbines 108 and 120 exceeds the desired minimum, the valves 116 and 117 are closed. A similar desired minimum steam flow must be maintained through the reheater sections. For purposes of this discussion, the desired minimum steam flow is sufficient to generate 25% of maximum power plant output. It is understood that the power output corresponding to the desired minimum steam flow may vary, depending upon the particular design of the steam generators. It is recognized that each of the throttle valves 106 and 118 and each of the governor valves 107 and 119 corresponds to a plurality of such valves in typical practice.

An auxiliary steam turbine ASTA uses steam from the cold reheat header 109 to rotate the helium circulator 102A. Similarly auxiliary steam turbines ASTB and ASTC use steam from the cold reheat header 109 to rotate the helium circulators 102B and 102C respectively. A dashed line connecting the auxiliary steam turbine ASTC and the helium circulator 102C illustrates the rotational coupling of those elements. A control valve associated with each auxiliary steam turbine governs the steam flow through the auxiliary turbine, and thereby governs the rate of flow of reactor coolant gas through the corresponding helium circulator. Exhaust steam from the auxiliary steam turbine ASTA passes to the inlet of the reheater, RHA, and exhaust steam from the auxiliary steam turbines ASTB and ASTC similarly is discharged to the inlets of the respective reheaters RHB and RHC. A bypass line and bypass flow control valve are connected between the cold reheat header 109 and the inlet of each of the reheater sections RHA, RHB and RHC. At times when the total steam flow into the cold reheat header 109 exceeds the total steam flow through the auxiliary steam turbines, the bypass valves associated with the auxiliary steam turbines are positioned such that the bypass lines conduct the excess steam flow directly to the reheater section inlets. A hot reheat header 125 is connected to receive reheated steam from the outlets of the reheater sections. When more than three steam generators are utilized, the reheater section, the helium circulator and the auxiliary steam turbine corresponding to each additional steam generator are connected as above described.

From the hot reheat header 125 steam may flow through a stop valve 126 and an intercept valve 127 to the inlet of the intermediate pressure turbine 111. Exhaust steam from the turbine 111 flows through a line 128 to the inlet of the low pressure turbine 112. A line 129 conducts exhaust steam from the turbine 112 to a condenser 130. A condenser bypass line 131 is connected to conduct steam from the hot reheat header 125 to the condenser 130, and a condenser bypass valve 132 is connected to govern the steam flow through the line 131. An alternate bypass line 133 is connected between the hot reheat header 125 and an alternate steam receiving means, the alternate steam receiving means being atmosphere in FIG. 1. An alternate bypass valve 134 is connected to govern the steam flow through the line 133. The valve 132 is positioned by a valve positioner 135, preferably an electrohydraulic positioner which hydraulically moves the valve 132 to a position related to an electrical signal transmitted to the positioner 135 on a line 136. The valve 134 is positioned by a valve positioner 137, preferably an electrohydraulic positioner which positions the valve 134 at a position related to an electrical input signal transmitted to the positioner 137 on a line 138.

For purposes of this discussion, the stop valve 126 is assumed to be open, unless otherwise stated. Thus the rate of steam flow through the turbines 111 and 112 is governed by the intercept valve 127, and the rate of steam flow through the turbine 108 is governed by the governor valve 107, or by the throttle valve 106. A device 170 generates a speed reference signal on a line 171 representative of a desired shaft speed of the A turbine-generator. The speed reference signal is transmitted to a speed control system 172 which generates a signal on a line 173 representative of a desired steam flow through the turbines 111 and 112 (intercept valve flow demand), a signal on a line **174*a* representative of a desired position of the governor valve 107, and a signal on a line 174*b* representative of a desired position of the throttle valve 106. An electrohydraulic valve positioner 175 positions the valve 127 to cause a steam flow through the turbines 111 and 112 that is effectively equal to the desired flow represented by the signal on the line 173. An electrohydraulic valve positioner 176a positions the governor valve 107 at a position represented by the signal on the line 174*a*. An electrohydraulic valve positioner 176b positions the throttle valve 106 at a position represented by the signal on the line 174*b*. As hereinafter described the speed control system 172 generates the desired steam flow signal on the line 173 and the desired valve position signals on the lines 174*a* and 174*b* such that the shaft speed of the A turbine-generator as detected by a speed detector 190 conforms to the value represented by the speed reference signal on the line 171. The device 170 may be a manually set variable signal generator with an output on the line 171, or the device 170 may be a digital computer programmed to calculate a megawatt demand value that is converted by an associated digital analog converter and transmitted to the line 171.**

A device 142 generates an output signal on a line 143 which represents a desired value of steam pressure in the hot reheat header 125. The device 142 may be a manually set variable signal generator, with an output on the line 143 or it may be a digital computer programmed to calculate such a desired pressure value, the calculated value being converted by an associated digital to analog converter and transmitted to the line 143. A pressure transducer 144 detects the pressure of steam in the hot reheat header 125, and generates an output signal representative of the detected pressure on a line 145. A bypass valve control system 146 is responsive to the desired pressure signal on the line 143, the detected pressure signal on the line 145, and the desired steam flow signal on the line 173 to generate the valve positioner input signals on the lines 136 and 138 as hereinafter described.

Steam may flow through a stop valve 147 and an intercept valve 148 to the inlet of the intermediate pressure turbine 122. Exhaust steam from the turbine 122 flows through a line 149 to the inlet of the low pressure turbine 123. After flowing through the low pressure turbine 123, steam is conducted by a line 150 to a condenser 151. Condensed feedwater from the condensers 130 and 151 flows through a line 152 to a series of pumps and heaters (not shown). Heated and pressurized feedwater is supplied to the steam generators through the line 103.

A condenser bypass line 153 is connected between the hot reheat header 125 and the condenser 151, and a condenser bypass valve 154 is connected to govern the steam flow through the line 153. An alternate bypass line 155 is connected between the hot reheat header 125 and an alternate steam receiving means, the alternate means being atmosphere in FIG. 1. An alternate bypass valve 156 is connected to govern the steam flow through the line 155. An electrohydraulic valve positioner 157 positions the valve 154 at a position related to a signal on an input line 158. An electrohydraulic valve positioner 159 positions the valve 156 at a position related to a signal on an input line 160.

For the purposes of this discussion, it is assumed that the stop valve 147 is open, unless otherwise stated. Thus the rate of steam flow through the turbines 122 and 123 is governed by the intercept valve 148, and the rate of steam flow through the turbine 120 is governed by the governor valve 119, or by the throttle valve 118. A device 180 generates a speed reference signal on a line 181 representative of a desired shaft speed of the B turbine-generator. The speed reference signal is transmitted to a speed control system 182 which generates a signal on a line 183 representative of a desired steam flow through the turbines 122 and 123 (intercept valve flow demand), a signal on a line 184*a* representative of a desired position of the governor valve 119, and a signal on a line 184*b* representative of a desired position of the throttle valve 118. An electrohydraulic valve positioner 185 positions the valve 148 to cause a steam flow through thr turbines 122 and 123 that is effectively equal to the desired flow represented by the signal on the line 183. An electrohydraulic valve positioner 186*a* positions the governor valve 119 at a position represented by the signal on the line 184*a*. An electrohydraulic valve positioner 186*b* positions the throttle valve 118 at a position represented by the signal on the line 184*b*. As hereinafter described the speed control system 182 generates the desired steam flow signal on the line 183 and the desired valve position signals on the lines 184*a* and 184*b* such that the shaft speed of the B turbine-generator as detected by a speed detector 191 conforms to the value represented by the speed reference signal on the line 181. The device 180 may be a manually set variable signal generator with an output on the line 181, or the device 180 may be a digital computer programmed to calculate a megawatt demand value that is converted by an associated analog to digital converter and transmitted to the line 181.

A device 163, which may be a manually set signal generator or a programmed digital computer with an associated digital to analog converter, generates a signal on a line 164 representative of a desired value of steam pressure in the hot reheat header 125. A bypass valve control system 165 is responsive to the detected pressure signal on the line 145, the desired pressure signal on the line 164, and the desired steam flow signal on the line 183 to generate the valve positioner input signals on the lines 158 and 160, as hereinafter described.

Although the stop valves 126 and 147 and the intercept valves 127 and 148 are illustrated as single valves in FIG. 1, it is recognized that each valve corresponds to plurality of valves in typical practice.

Figure 2:
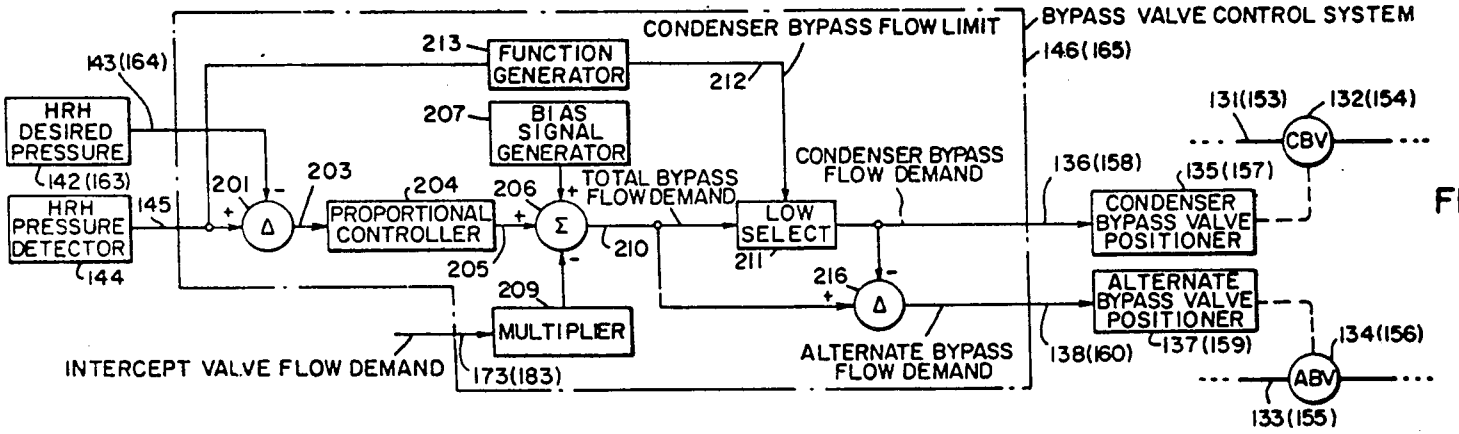
FIG. 2 shows details of a bypass control system included in the power plant of FIG. 1.

Referring to FIG. 2, the bypass valve control system 146 is responsive to the intercept valve flow demand signal on the line 173 to govern the steam flows through the condenser bypass line 131 and the alternate bypass line 133 at such rates that the combined steam flow through the turbines 111 and 112 and the bypass lines 131 and 133 is equal to one-half the desired minimum steam flow through the reheater sections at times when the steam flow through turbines 111 and 112 is less than one-half the desired minimum. Because the desired minimum steam flow is sufficient to generate 25% maximum plant power output, it follows that one-half the desired minimum steam flow is sufficient to generate 25% maximum power output of one turbine-generator, as the maximum power capabilities of the A and B turbine-generators are equal. Thus, the steam flow through the turbines 111 and 112 is less than one-half the desired minimum at times when the A turbine-generator is shut down, when the A turbine-generator is being accelerated prior to synchronization, after synchronization, when the power output of the A turbine-generator is less than 25% of its maximum power output, and following a trip of the A turbine-generator at a power output in excess of 25% of its maximum power output. The bypass valve control system 146 also responds to a difference between the desired and detected hot reheat header steam pressure signals on the respective lines 143 and 145 to vary the steam flow through one of the bypass lines 131 and 133 to reduce such difference. Usually the bypass valve control system 146 holds the alternate bypass valve 134 closed and varies the steam flow through the condenser bypass line 133 to reduce a difference between the desired and detected pressure signals. However, the bypass valve control system 146 opens the alternate bypass valve 134 to prevent the steam flow through the condenser bypass line 131 from exceeding a corresponding flow limit. When the alternate bypass valve 134 is open, the control system 146 positions the condenser bypass valve 132 to maintain the steam flow through the condenser bypass line 131 at the limit value, and varies the steam flow through the alternate bypass line 133 to reduce a difference between the desired and detected pressure signals.

In more detail with reference to FIG. 2 the intercept valve steam flow demand signal on the line 173 is transmitted through a multiplier 209 to a first input of a summing device 206. A bias signal generator 207 generates a constant bias signal which is connected to a second input of the summing device 206. A comparator 201 generates an output signal on a line 203 which is representative of the difference between the detected pressure signal on the line 145 and the desired pressure signal on the line 143. The signal on the line 203 is transmitted to a proportional controller 204, which generates an output signal connected on a line 205 to a third input of the summing device 206. The summing device 206 subtracts the output signal of the multiplier 209 from the constant bias signal, and adds to the difference of those signals the third input signal on the line 205, to generate an output signal on a line 210. The signal on the line 210 represents total bypass steam flow demand, to be satisfied by steam flow through the condenser bypass line 131 if that flow is less than a corresponding flow limit, or by the combined steam flow through the condenser bypass line 131 and the alternate bypass line 133, otherwise.

The line 210 is connected to a first input of a low select 211. A signal representing a limit value of steam flow through the condenser bypass line 131 is generated by a function generator 213 and is transmitted by a line 212 to a second input of the low select 211. If the total bypass steam flow demand signal is less than the condenser bypass flow limit signal, the low select 211 transmits the total bypass steam flow demand signal to the valve positioner 135, which positions the condenser bypass valve 132 to cause a flow of steam through the condenser bypass line 131 effectively equal to the total bypass steam flow demand, when the steam pressure in the header 125 is at a "low load pressure value." If the total bypass steam flow demand signal exceeds the condenser bypass flow limit signal, the low select 211 transmits the condenser bypass flow limit signal to the valve positioner 135. A comparator 216 generates an output signal representing the excess of the total bypass steam flow demand over the condenser bypass flow limit, and the valve positioner 137 positions the alternate bypass valve 134 to cause a steam flow through the line 133 effectively equal to the flow represented by the output signal of the device 216. The valve positioner 135 positions the condenser bypass valve 132 to cause a flow of steam through the line 131 effectively equal to the condenser bypass flow limit. Then the combined steam flow through the lines 131 and 133 is effectively equal to the total bypass steam flow demand, when the steam pressure in the header 125 is at a low load pressure value. The output signal of the comparator 216 is zero whenever the total bypass steam flow demand is less than the condenser bypass flow limit, and the alternate bypass valve positioner 137 then holds the alternate bypass valve 134 closed.

Each of the bypass control valves 132 and 134 is characterized by a linear relationship between valve position and steam flow through the valve at constant differential pressure across the valve. The valve positioner associated with each bypass control valve moves the respective valve to a position which is linearly related to the input signal to which the positioner responds. Bypass control valves having non-linear characteristics may be used; when such valves are used each valve positioner is modified to move the associated bypass control valve to a position which is non-linearly related to the respective valve positioner input signal, to compensate the non-linearity of the bypass control valve. A plurality of valves may be utilized to perform the function of the condenser bypass valve 132 or of the alternate bypass valve 134. In that instance a valve positioner is provided for each such valve, and the positioners operate in concert to cause a steam flow through the respective bypass line which is effectively equal to that when a single valve and associated valve positioner are used.

Provided that the detected pressure of steam in the hot reheat header 125 does not deviate from the desired value, the input and output signals of the proportional controller 204 are zero, and the total bypass steam flow demand signal is a function solely of the intercept valve steam flow demand. If the detected pressure of steam in the header 125 differs from the desired pressure, a pressure difference signal is generated by the comparator 201 and is transmitted through the proportional controller 204 to the summing device 206, which modifies the total bypass steam flow demand signal according to the output signal of the controller 204. As the bypass valves 132 and 134 are positioned to satisfy the modified total bypass steam flow demand signal, the pressure difference is reduced.

The following equation relates to the function generator 213:

$$BTU_{max} = K_l \times F_{max} \times HRHP$$

wherein $BTU_{max}$ = maximum allowable rate of heat delivery to the condenser 130 by the condenser bypass line 131, $K_l$ = proportionality constant, $F_{max}$ = maximum steam flow through the condenser bypass line 131 corresponding to $BTU_{max}$, $HRHP$ = hot reheat header (125) steam pressure. Hence $F_{max} = BTU_{max}/(K_1 \times HRHP)$. In the latter relationship the maximum steam flow in the condenser bypass line 131 varies inversely with the pressure of steam in the header 125. Therefore the function generator 213 is responsive to the output signal of the pressure transducer 144, which represents the detected pressure of steam in the header 125, to generate the signal on the line 212, which represents $F_{max}$, according to the above relationship.

Figure 3A:
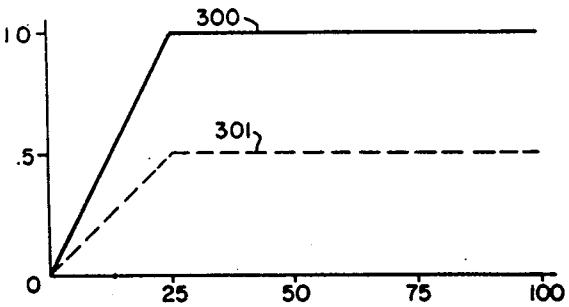
FIGS. 3*a* and 3*b*, graphically illustrate operational aspects of the bypass control system of FIG. 2.

Referrring to FIG. 3A the intercept valve steam flow demand signal on the line 173 is graphically represented (line 300) in relation to the power output of the A turbine-generator. On the vertical axis the intercept valve steam flow demand is shown on a scale normalized between 0 and 1.0. On the horizontal axis the power output of the A turbine-generator is shown in percent of the maximum power output of that turbine-generator. The intercept valve steam flow demand increases from 0 to 1.0 as the power output increases from 0 to 25%. An intercept valve flow demand of 0 causes the valve positioner 175 (see FIG. 1) to close the intercept valve 127. An intercept valve flow demand of 1.0 causes the valve positioner 175 to open fully the intercept valve 127. Over the power output range 25% to 100% the intercept valve flow demand is constant at 1.0, and the valve positioner 175 holds the intercept valve 127 fully open over such power output range. Between 0 and 25% power output, the desired steam pressure in the hot reheat header 125 is regulated at a constant value (the low load pressure value) such that fully opening the intercept valve 127 causes a steam flow through the turbines 111 and 112 effectively equal to one-half the desired minimum steam flow through the reheater sections (see FIG. 1). As the power output of the A turbine-generator increases from 0 to 25%, the corresponding steam flow through the turbines 111 and 112 increases from zero to one-half the desired minimum steam flow.

Again with reference to FIG. 3A, a dashed line 301 graphically represents the output signal of the multiplier 209 (see FIG. 2) in relation to the power output of the A turbine-generator The multiplier 209 multiplies the intercept valve steam flow demand signal by a constant factor of 0.5, therefore the output signal of the multiplier 209 increases in value from 0 to 0.5 as the power output increases from 0 to 25%. Above 25% power output, the output signal of the multiplier 209 is constant at 0.5.

Figure 3B:
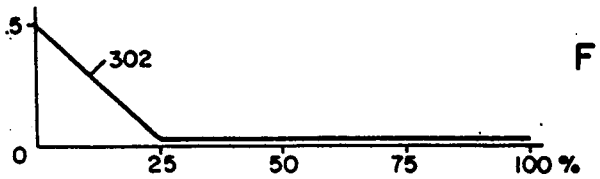

Referring now to FIG. 3B the total bypass steam flow demand signal on the line 210 (see FIG. 2) is graphically represented (line 302) in relation to the power output of the A turbine-generator. On the vertical axis the total bypass steam flow demand signal is shown on a scale between 0 and 0.5. On the horizontal axis the power output of the A turbine-generator is shown in percent. The bias signal generated by the signal generator 207 (see FIG. 2) has a constant valve of 0.5 in relation to the output signal of the multiplier 209, which is represented by the dashed line 301 of FIG. 3A. Assuming that the difference between the detected and desired values of hot reheat header steam pressure is zero, the comparator 201 (see FIG. 2) generates a zero output signal on the line 203, and the signal on the line 205 accordingly is zero. Then the total bypass steam flow demand signal is generated by the summing device 206 (see FIG. 2) according to the difference between the constant bias signal of value 0.5 and the output signal of the multiplier 209. As shown in FIG. 3B the total bypass steam flow demand signal decreases from 0.5 to 0 as the power output of the A turbine-generator increases from 0 to 25%. Above 25% power output, the total bypass steam flow demand is constant at 0. A total bypass steam flow demand of 0.5 causes the condenser bypass valve positioner 135 to position to condenser bypass valve 132 such that the steam flow through the condenser bypass line 131 is effectively equal to one-half the desired minimum steam flow, when the pressure of steam in the hot reheat header 125 is at the low load pressure value, and the condenser bypass flow limit is greater than one-half the desired minimum steam flow. Otherwise the valve positioners 135 and 137 position the bypass valves 132 and 134 so that the combined steam flow through the condenser bypass line 131 and the alternate bypass line 133 is effectively equal to one-half the desired minimum, when the hot reheat steam pressure is at the low load pressure value. A total bypass steam flow demand of 0 causes the valve positioners 135 and 137 to hold the bypass valves 132 and 134 closed. Thus the combined steam flow through the bypass lines 131 and 133 decreases from one-half the desired minimum steam flow to zero, as the power output of the A turbine-generator increases from 0 to 25%, on the assumption that no pressure difference signal is generated by the comparator 201.

The heavy line 300 of FIG. 3A shows a linear relationship between power output and intercept valve flow demand between 0 and 25% maximum power output for purposes of clarity and simplicity of exposition, and should not be construed as a limitation. The bypass valve control system 146 is equally effective in response to a non-linear relationship between power output and intercept valve flow demand over such power output range as long as the intercept valve is fully opened at 25% maximum power output.

It is understood that values other than 0.5 may be used for the gain of the multiplier 209 and the value of the bias signal. For example, the bias signal value and the multiplier gain may each be 1.0, in which case the line 173 would be connected directly to the summing device 206 and the valve positoners 135 and 137 would be arranged to a position the respective valves 132 and 134 to cause a total steam flow through the lines 131 and 133 which is effectively equal to one-half the desired minimum steam flow when the total bypass flow demand is 1.0 and the hot reheat header steam pressure is at the low load pressure value. The value 0.5 is suitable when the condenser 135 is capable of condensing the total desired minimum steam flow at the low load pressure value of hot reheat steam pressure.

Over the power output range 0 to 25% the output signal of the device 142 represents a constant desired pressure equal to the low load pressure value. From the above discussion, it is evident that over such power output range the bypass valve control system 146 governs the steam flow through the condenser bypass line 131 and the alternate bypass line 133 so that the combined steam flow through such bypass lines and the turbines 111 and 112 is effectively equal to one-half the desired minimum steam flow, assuming no difference between the detected and desired values of hot reheat header steam pressure. Between power output levels of 0 and 25% an increase of steam flow through the turbines 111 and 112 is accompanied by a corresponding decrease of steam flow through the bypass lines 131 and 133, and in effect the bypass control system 146 "transfers" bypass steam flow to the turbines 111 and 112 as the power output of the A turbine-generator increases, while regulating the steam pressure in the hot reheat header 125.

If a difference between the detected and desired values of hot reheat header steam pressure occurs, the bypass valve control system 146 varies the steam flow through one of the bypass lines 131 and 133 to reduce the difference. In practice such a pressure difference cannot be reduced to zero, as the controller 204 is a proportional controller and permits a residual pressure difference. However, the value of the bias signal generated by the signal generator 207 is such that the magnitude of the residual pressure difference is effectively minimized.

Between 0 and 25% maximum total plant power output the reactor 100 and the helium circulators 102A-102C are operated by controls (not shown) so that the reheater sections of the steam generators are capable of supplying the desired minimum flow of reheated steam when the hot reheat header steam pressure is at the low load pressure value. Then the bypass valve control system 146 regulates the steam pressure in the header 125 according to the low load pressure value and simultaneously governs the steam flow through the bypass lines 131 and 133 so that the combination of steam flows through such lines with the steam flow through the turbines 111 and 112 effectively equals one-half the desired minimum steam flow. If the reactor 100 and the helium circulators 102A–102C are not operated to supply the desired minimum flow of reheated steam at the low load pressure value, the bypass valve control system 146 varies the steam flow through the bypass lines 131 and 133 to regulate the steam pressure in the hot reheat header 125 according to the desired low load value, but the total steam flow through the bypass lines 131 and 133 and the turbines 111 and 112 differs from one-half the desired minimum steam flow by an amount which depends upon the operation of the reactor and helium circulators.

With reference to FIG. 2 identification numbers in parentheses refer to the bypass valve control system 165 associated with the B turbine-generator. The elements and connection of the bypass valve control system 165 are shown within the dashed lines in FIG. 2. The above description of the connection and operation of the bypass valve control system 146 also relates to the control system 165 provided that the numbers in parentheses are substituted for the corresponding numbers in the text, and that the expressions "turbines 122 and 123", "B turbine-generator", "intercept valve 148", and "valve positoner 185" are substituted respectively for the expressions "turbines 111 and 112", "A turbine-generator", "intercept valve 127", and "valve positioner 175".

The arrangement for controlling the shaft speed of the A turbine-generator (see FIG. 1) is described in greater detail with reference to FIG. 4. Reference numerals in FIG. 4 not within parentheses relate to the A turbine-generator, for which details of the speed control arrangement are given below. The description of the speed control arrangement for the A turbine-generator also relates to the speed control arrangement for the B turbine-generator (see FIG. 1), provided that reference numerals in parentheses in FIG. 4 are substituted for their corresponding reference numerals when the corresponding numerals appear in the description which follows.

Figure 4:
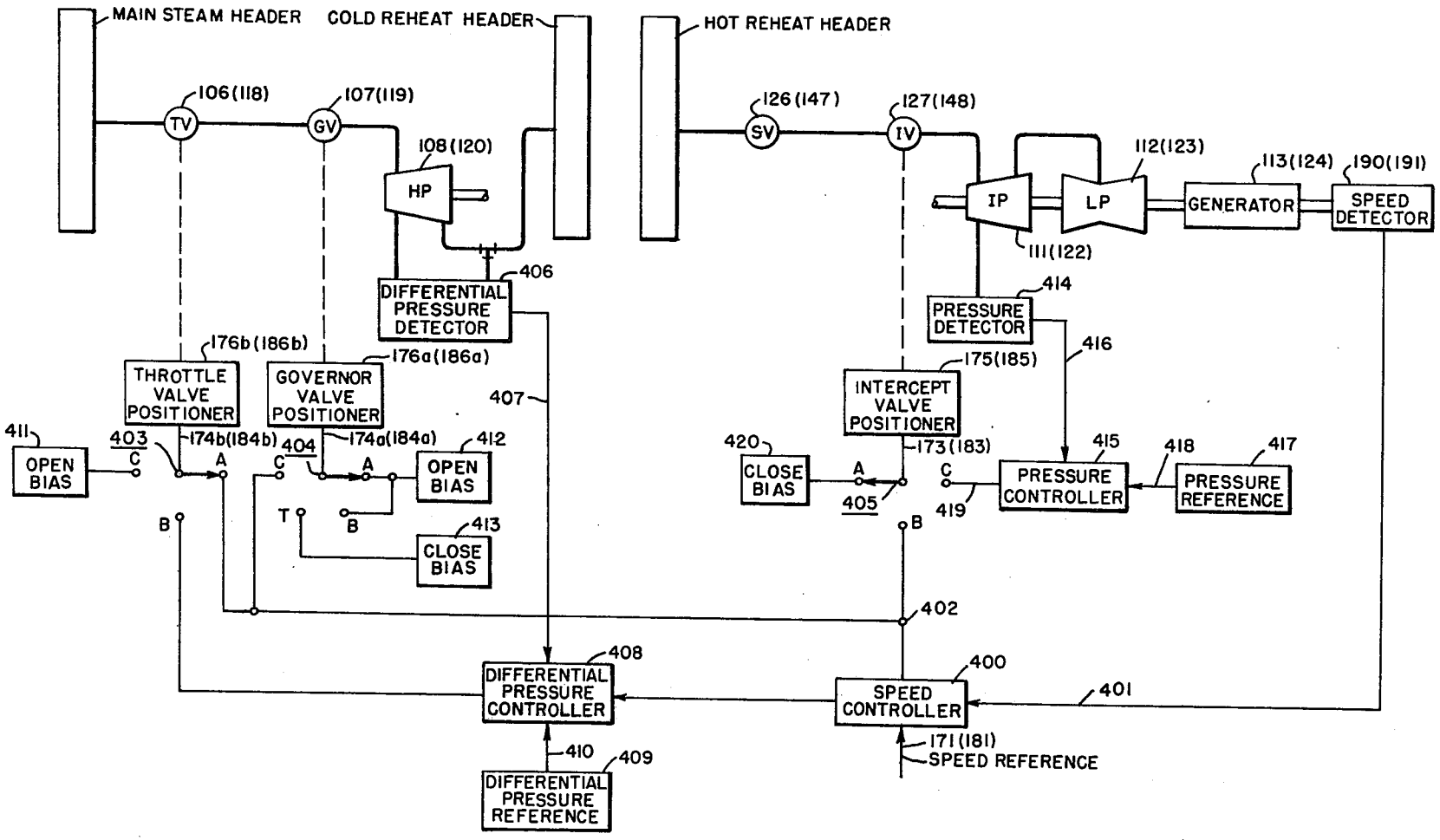
FIG. 4 schematically illustrates details of an acceleration control system according to the present invention and included in the power plant of FIG. 1.

With reference to FIG. 4, the speed reference signal on the line 171 is connected to a speed controller 400. Also connected to the speed controller 400 is a signal on a line 401 representing the shaft speed of the A turbine-generator as detected by the speed detector 190. The speed controller 400 is responsive to a difference between the signals on the lines 171 and 401 to generate a corrective signal on a line 402, which signal is transmitted to the valve positioner associated with one of the valves 106, 107 and 127, depending upon the shaft speed of the A turbine-generator. When the respective valve is positoned in accordance with the signal on the line 402, a difference between the signals on the lines 171 and 401 is reduced.

The purpose of the speed control arrangement of FIG. 4 is to accelerate the A turbine-generator from turning gearspeed to synchronous speed in accordance with the speed reference signal on the line 171. The speed range between turning gear speed and synchronous speed is divided into three non-overlapping subranges; speeds less than X rpm; speeds from X rpm to y rpm; and speeds from Y rpm to synchronous speed. Typically X rpm is approximately 1800 rpm and Y rpm is about 3300 + 3450 rpm (where 3600 rpm is synchronous speed).

The signal on the line 402 is transmitted to a terminal A of a switch 403; to a terminal C of a switch 404; and to a terminal B of a switch 405. Each of the switches 403, 404, and 405 is connected to transmit a signal from one of its terminals to the input of an associated valve positioner. In particular, the switch 403 selects the input signal to the throttle valve positioner 176B, and the throttle valve 106 is positioned in accordance with the selected input signal. The switch 404 selects the input signal to the governor valve positioner 176A, which input signal determines the position of the governor valve 107. The switch 405 selects the input signal to the intercept valve positioner 175, and the intercept valve 127 is positioned according to such input signal. As will be seen, only one of the switches 403, 404 and 405 transmit the corrective signal on the line 402 to its valve positioner at a time, the valve positioner receiving such signals as its input signal depending upon the speed subrange which includes the detected shaft speed of the A turbine-generator.

A differential pressure detector 406 is connected to measure the difference between the pressure of steam in the impulse chamber of the high pressure turbine 108 and the pressure of steam at the exhaust of the turbine 108. The detector 406 generates a signal on a line 407 representing the detected pressure differential; such signal is coupled to one input of a differential pressure controller 408. A device 409, such as a potentiometric voltage source or a digital computer with an analog output, generates a signal on a line 410 which is coupled to a second input of the controller 408, the signal on the line 410 representing a desired value of the previously mentioned pressure differential between the impulse chamber and the exhaust of the turbine 108. In accordance with the difference between the signals on the lines 407 and 410, the controller 408 generates a corrective signal which is coupled to a terminal B of the switch 403; when the switch 403 is in the B position, the throttle valve 106 is positioned to vary the steam flow through the turbine 108 to reduce a difference between the signals on the lines 407 and 410.

When placed in position C, the switch 403 transmits a steady signal to the input of the throttle valve positioner 176B, such signal having a sufficiently high level to cause the positioner 176B to hold the throttle valve 106 fully open (an open bias signal). The open bias signal is generated by a signal generator 411.

With respect to the switch 404, a signal generator 412 generates a steady signal that is transmitted to the input of the governor valve positioner 176A when the switch is placed in the A and B positions. The output signal of the generator 412 is of sufficient level to cause the positioner 176A to hold the governor valve 107 fully open. When placed in position T, the switch 404 transmits a ramp signal to the input of the governor valve positioner 176A to cause the positioner to close the governor valve 107 quickly in a ramp fashion. The ramp closure signal connected to the terminal T of the switch 404 is generated by a close bias signal generator 413.

A pressure detector 414 is connected to detect the pressure of steam in the first stage of the intermediate pressure turbine 111. A signal representative of the detected pressure is transmitted to a pressure controller 415 on a line 416. A signal generator 417, such as a potentiometric voltage source or a digital computer with an analog output, generates a pressure reference signal on a line 418 which is connected to the pressure controller 415. The signal on the line 418 represents a desired value of the pressure of steam in the first stage of the intermediate pressure turbine 111. When there is a difference between the signals on the lines 416 and 418, the controller 415 generates a signal on a line 419 in accordance with such difference. The line 419 is connected to position C of the switch 405; when placed in position C, the switch 405 transmits the signal on the line 419 to the input of the valve positioner 175 whereby the intercept valve 127 is positioned to vary the steam flow through the turbines 111 and 112 to reduce a difference between the detected pressure signal on the line 416 and the desired pressure signal on the line 418.

When it is placed in positon A, the switch 405 transmits a steady signal to the input of the valve positioner 175 of such level as to cause the intercept valve 127 to be held closed. Such signal is generated by a close bias signal generator 420.

In operation the arrangement shown in FIG. 4 controls the shaft speed of the A turbine-generator in accordance with the speed reference signal on the line 171, which generally is increased from a level corresponding to turning gear speed to a level corresponding to synchronous speed, at a rate which is compatible with the thermal requirements of the turbine internal parts, whereby no part is subjected to harmful thermal conditions. The purpose of the arrangement shown in FIG. 4 is to vary the steam flows through the turbine portions to govern the detected turbine shaft speed according to the speed reference signal on the line 171, in order to accelerate the A turbine-generator to synchronous speed for subsequent synchronization of the generator 113 with its associated power system (not shown).

At speeds less than X rpm, the switch 405 is placed in position A and no steam passes through the turbines 111 and 112. Between turning gear speed and X rpm, the steam flow through the turbine 108 thus controls the speed of the A turbine-generator. Over such speed range, the switch 403 is placed in the A position, to couple the output signal of the speed controller 400 to the throttle valve positioner 176*b*. As the speed reference signal on the line 171 is increased to X rpm, the speed controller 400 and the throttle valve positioner 176*b* vary the steam flow through the turbine 108 to govern the speed detected by the speed detector 190 according to the speed reference signal. At speeds below X rpm, the switch 404 is placed in the A position to hold the governor valve 107 fully open.

At X rpm, the differential pressure reference signal on the line 410 is set to represent the pressure differential that is detected by the pressure differential detector 406 at such speed. The switch 403 is placed in the B position and is maintained in that position at speeds from X to Y rpm. Thus by the position of the throttle valve of 106 is varied to maintain the detected pressure differential at the reference value specified by the signal on the line 410. Due to the substantially constant pressure differential, an effectively steady flow of steam through the turbine 108 is maintained at speeds from X to Y rpm, the level of such flow being effectively that which prevailed when the shaft speed reached X rpm. The switch 404 is placed in the B position to hold the governor valve 107 fully open at speeds from X to Y rpm.

At X rpm the switch 405 is placed in the B position and it remains at such position until the shaft speed reaches Y rpm. Thus the shaft speed of the A turbine-generator is governed by the flow of steam through the turbines 111 and 112 at speeds between X and Y rpm. As the speed reference signal on the line 171 is increased from X to Y rpm, the output signal of the speed controller 400 is coupled through the switch 405 to the valve position 175. Thus the intercept valve is positioned to govern the steam flow through the turbines 111 and 112 so that the speed detected by the speed detector 190 is effectively equal to the reference speed represented by the signal on the line 171, at speeds from X to Y rpm.

At Y rpm, the pressure reference signal generator 417 is set to represent the pressure of steam which is detected by the pressure detector 414 at such speed; the pressure reference signal on the line 418 is maintained at such level at speeds in excess of Y rpm. At Y rpm the switch 405 is placed in the C position and remains in such position as the speed of the A turbine-generator is increased. At speeds above Y rpm, the intercept valve 127 is positioned in accordance with the output signal of the pressure controller 415, whereby the pressure of steam in the first stage of the turbine 11 is maintained at a level effectively equal to the level specified by the pressure reference signal on the line 418. Thus a substantially constant flow of steam is maintained through the turbines 111 and 112 at speeds in excess of Y rpm, the level of such steam flow being effectively equal to the level of the flow which prevailed when the shaft speed of the A turbine-generator reached Y rpm.

At Y rpm, control of the speed of the A turbine-generator is transferred from the intercept valve 127 to the governor valve 107. To accomplish this transfer, the switch 404 is placed in position T to cause the governor valve 107 to be ramped closed quickly. The switch 403 then is placed in position C to open fully the throttle valve 106 after the governor valve 107 is fully closed. With the throttle valve 106 fully opened, the switch 404 is placed in the C position, to transmit the output signal of the speed controller 400 to the input of the governor valve positioner 176*a*. Thus the governor valve 107 is positioned to vary the steam flow through the turbine 108 so that the shaft speed of the A turbine-generator, as detected by the speed detector 190, is effectively equal to the speed reference on the line 171 at speeds in excess of Y rpm.

Over any one of the above-mentioned three speed ranges the system shown in FIG. 4 controls the detected shaft speed of the A turbine-generator by varying one, but not both, of the steam flows through the turbine 108 and through the turbines 111 and 112. Because the pressure of steam in the hot reheat header 125 is at an elevated level at all times during acceleration of the shaft of the A turbine-generator, variation of either the flow through the turbine 108 or through the turbines 111 and 112 is sufficient to govern the shaft speed. Although it is possible to vary both steam flows to govern the shaft speed, it is preferred to vary only one of them at a time, for purposes of simplicity.

During acceleration of the A turbine-generator, the bypass valve control system 146 (see FIG. 1) maintains the pressure of steam in the hot reheat header 125 at the level specified by the signal on the line 143, and compensates an increase of the steam flow through the turbines 111 and 112 by an equal decrease of the flow through the lines 131 and 133, for purposes of maintaining the desired minimum flow through the reheater sections. At times when the steam flow through the turbines 111 and 112 is varied for purposes of controlling the detected shaft speed of the A turbine-generator, such control is desirably more effective and requires less variaton of the positon of the intercept valve 127, because of the steady level of the pressure of steam in the hot reheat header 125.

As above described a constant differential is maintained between the impulse chamber and the exhaust of the turbine 108 at intermediate speeds (speeds between X and Y rpm), and a constant pressure is maintained in the first stage of the turbine 111 at speeds in excess of Y rpm. Thus there is a substantially constant steam flow through the turbine 108 at intermediate speeds, and a substantially constant steam flow through the turbines 111 and 112 at high speeds (speeds in excess of Y rpm) despite variation of the respective turbine flow control valves with temperature. These desirably steady steam flows assure even and adequate heating and cooling of various portions of the turbines through which the flows pass, and permit a higher accuracy of shaft speed control than is possible when such flows vary during acceleration.

Figure 5:
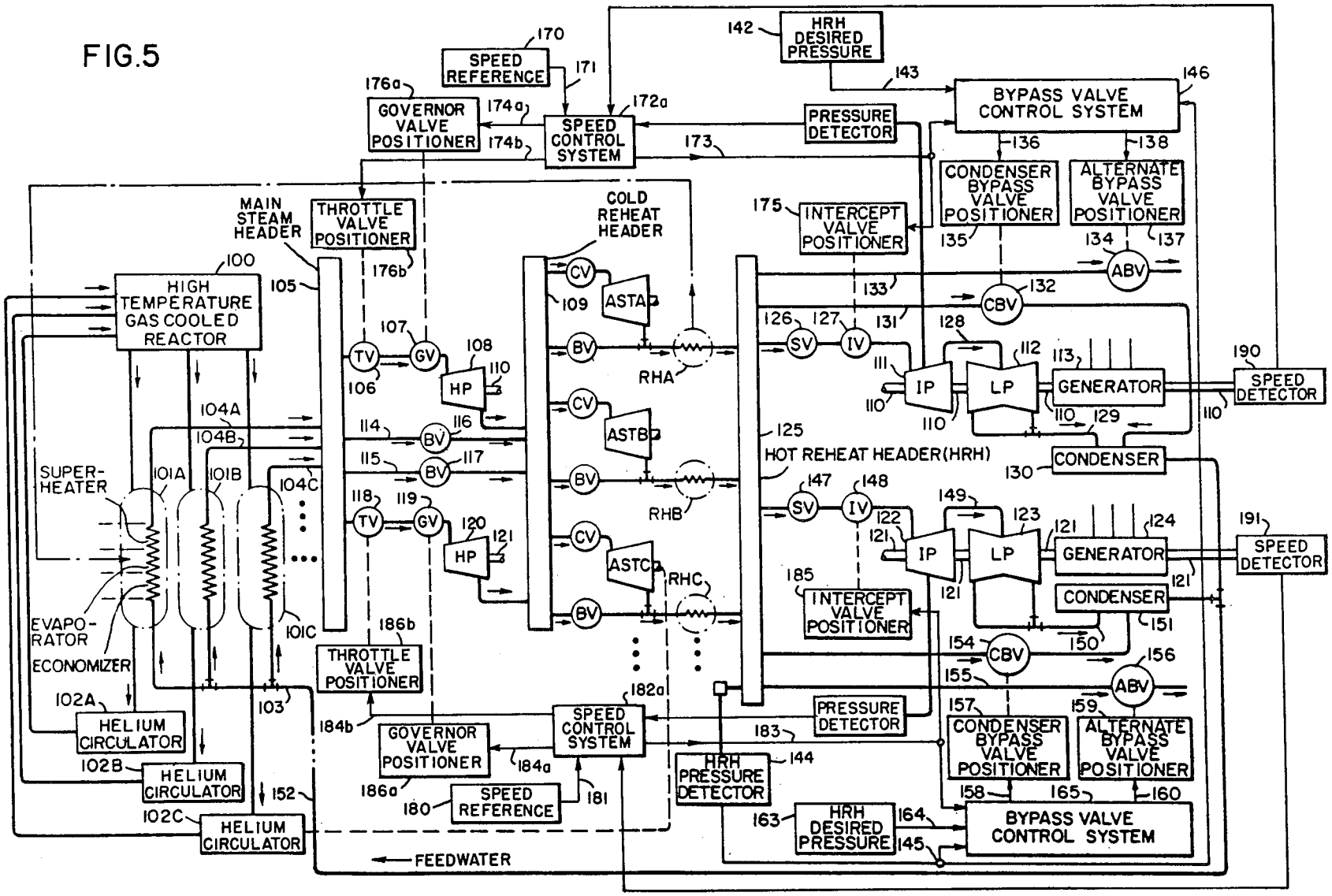
FIG. 5 schematically shows another electric power plant according to the present invention.

Referring now to FIG. 5 there is shown a dual turbine power plant as described with respect to FIG. 1 except that the speed control systems 172*a* and 182*a* shown in FIG. 5 differ from the speed control systems 172 and 182 shown in FIG. 1, while the differential pressure detectors related to the turbines 108 and 120 (see FIG. 1) are not included in FIG. 5. An arrangement for controlling the shaft speed of the A turbine-generator as shown in FIG. 5 is described in further detail with reference to FIG. 6. Reference numerals in FIG. 6 not within parentheses relate to the A turbine-generator, for which details of the speed control arrangement are presented below. The description of the speed control arrangement for the A turbine-generator also relates to such an arrangement for the B turbine-generator (see FIG. 5) provided that reference numerals in parentheses in FIG. 6 are substituted for their corresponding reference numerals when the corresponding numerals appear in the description which follows.

Figure 6:
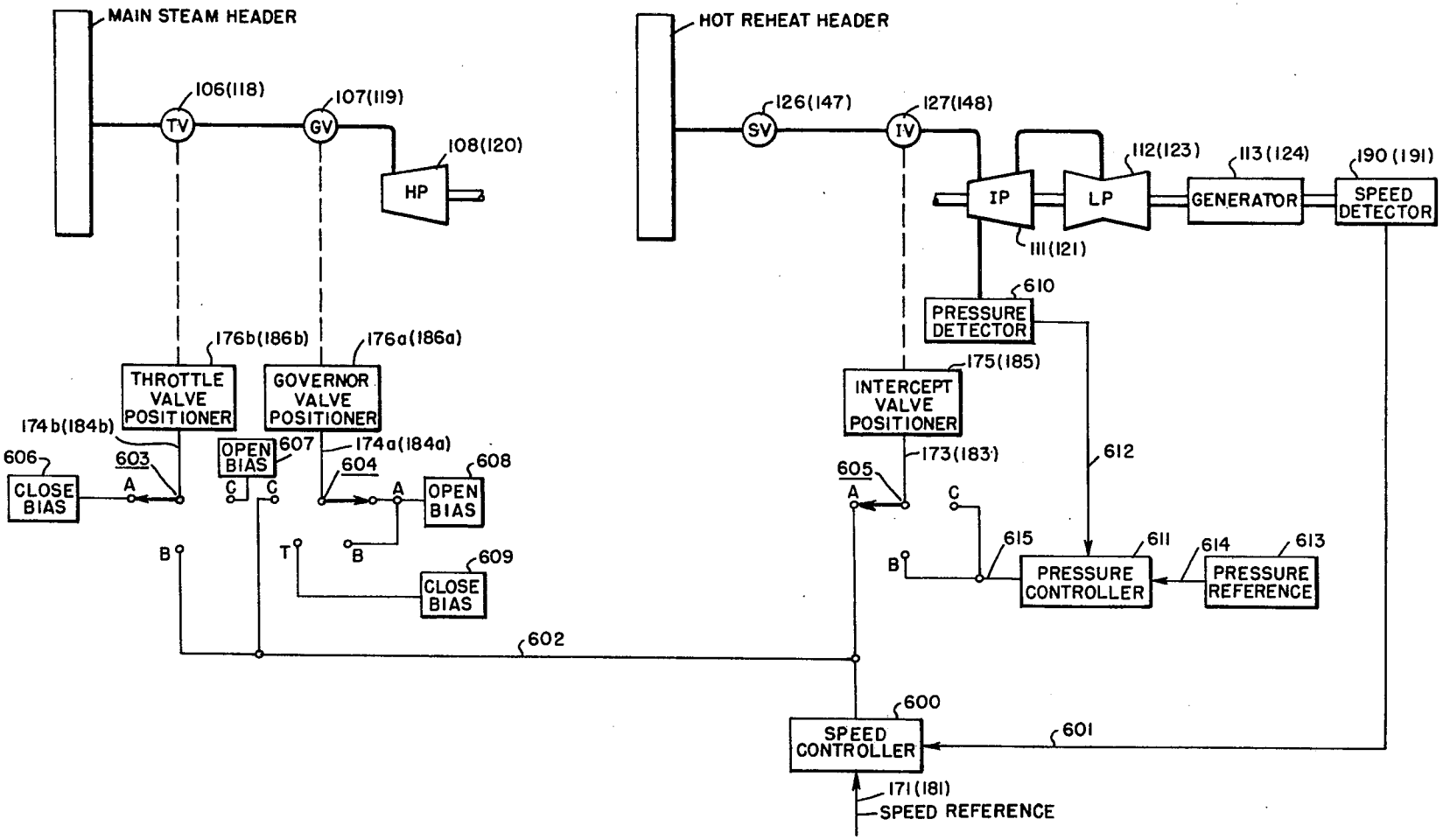
FIG. 6 schematically shows details of an acceleration control system according to the present invention and included in the power plant of FIG. 5.

Referring now to FIG. 6 the speed control arrangement controls the detected shaft speed of the A turbine-generator according to the speed reference signal on the line 171. A speed controller 600 compares the speed reference signal on the line 171 with the signal on a line 601, which signal represents the shaft speed detected by the speed detector 190. In response to a difference between the signals on the lines 171 and 601, the speed controller 600 generates an output signal on a line 602 that is coupled to one of the valve positioners 175, 176*a*, and 176*b* by a respective one of the switches 603, 604 and 605. Thus at any time one of the valves 106, 107 and 127 is positioned according to the signal on the line 602 to vary the steam flow through its associated turbine portion to govern the detected shaft speed of the A turbine generator, in accordance with the speed reference signal on the line 171. In particular, the switch 605 when placed in the A position, couples the signal on the line 602 to the input of the intercept valve positioner 175 at speeds less than X rpm; the switch 603, when placed in the B position, couples the output signal of the controller 600 to the input of the throttle valve positioner 176*b* at speeds from X to Y rpm; at speeds above Y rpm; the switch 604, in the C position, couples the output signal of the controller 600 to the input of the governor valve position 176*a*.

With respect to the switch 603, placement of such switch in the A positon couples the close bias signal that is generated by a generator 606 to the valve positioner 176*b* to hold the throttle valve 106 closed, while placement of the switch in the C position couples an open bias signal generated by a generator 607 to the input of the positioner 176*b*, to hold the throttle valve 106 fully open.

A signal generator 608 generates an open bias signal which is coupled by a switch 604, when placed in the A and B positions, to the input of the valve positioner 176*a*, for purposes of holding the governor valve 107 fully open. A signal generator 609 generates a ramp output signal that is coupled by the switch 604, in the T position to the input of the positioner 176*a*. Placement of the switch 604 in the T position causes the governor valve 107 to be ramped closed quickly.

A pressure detector 610 is connected to detect the pressure of steam in the first stage of the turbine 111; a signal representing the detected pressure is connected to an input of a pressure controller 611 on a line 612. A signal generator 613, such as a potentiometric voltage source or a digital computer with an analog output generates a signal on a line 614 that is coupled to a second input of the pressure controller 611. The signal on the line 614 represents a desired value of the pressure of steam in the first stage of the turbine 111. In accordance with the difference between the signal, on the lines 614 and 612 the pressure controller 611 develops an output signal on a line 615. When the switch 605 is placed in the B or C positions, the output signal of the pressure controller 611 is coupled to the input of the valve positioner 175, whereby the intercept valve 127 is positioned according to the signal on the line 615 to reduce the difference between the signals on the lines 612 and 614. Thus the pressure detected by the detector 610 is governed so that it is effectively equal to the reference pressure that is represented by the signal on the lines 614.

At speeds less than X rpm, the throttle valve 106 is held closed with the switch 603 in position A; with the switch 604 in position A the governor valve 107 is held fully open. At such speeds no steam passes through the turbine 108.

As the speed reference signal on the line 171 increases from a level corresponding to turning gear speed to a level corresponding to X rpm, the switch 605 remains in the A position to connect the output signal of the speed controller 600 to the input of the valve positioner 175. Hence the intercept valve 127 is positioned in accordance with the signal on the line 602 to vary the steam flow through the turbines 111 and 112 to govern the detected shaft speed of the A turbine generator in accordance with the speed reference signal on the line 171.

At X rpm the pressure reference signal on the line 614 is set to represent the pressure of steam in the first stage of the turbine 111, as detected by the pressure detector 610 at such speed. The signal on the line 614 remains at such level at speeds in xcess of X rpm. From X rpm to synchronous speed, the intercept valve 127 thus is positioned according to the output signal of the pressure controller 611, whereby the pressure detected by the dectector 610 is governed to be effectively equal to the reference pressure level as represented by the signal on the line 614. As a result, a steady flow of steam is maintained through the turbines 111 and 112 at speeds in excess of X rpm, to assure adequate warming and cooling of various portions of such turbines. Also the relatively constant steam flow through the turbines 11 and 112 permits more accurate control of the shaft speed of the A turbine-generator with less variation of the steam flow through the turbines 108 than can be achieved when the flow through the turbines 111 and 112 varies, for example, as a result of temperature variation of valve components.

As the speed reference signal on the line 171 is increased from a level corresponding to X rpm to a level corresponding synchronous speed, the steam flow through the turbine 108 is varied to govern the detected shaft speed of the A turbine generator. From X to Y rpm, the throttle valve 106 is positioned to govern the shaft speed; above Y rpm, the governor valve 107 is positioned to control the shaft speed. In particular, each of the switches 603 and 604 is placed in positon B at X rpm and remains in such position until the shaft speed reaches Y rpm. As a result, the governor valve 107 is held fully open, while the throttle valve 106 is positioned according to the output signal of the speed controller 600; thus the throttle valve 106 is positioned to vary the steam flow through the turbine 108 to govern the detected shaft speed of the A turbine generator to be effectively equal to the reference speed represented by the signal on the line 171.

At Y rpm the switch 604 is placed in the T position to ramp the governor valve 107 closed. After the valve 107 is closed, the switch 603 is placed in the C position to open fully the throttle valve 106. Then the switch 604 is placed in position C to couple the output signal of the speed controller 600 to the input of the governor positoner 176*a*. At speeds in excess of Y rpm the governor valve 107 thus is positioned in accordance with the signal on the line 602 to vary the steam flow through the turbine 108 to govern the shaft speed of the A turbine-generator according to the speed reference signal on the line 171.

The system shown in FIG. 6 governs the detected shaft speed of the A turbine-generator according to the speed reference signal, which signal is increased from turning gear speed to synchronous speed for purposes of accelerating the turbine-generator for subsequent synchronization of the generator 113 with its associated power system (not shown). Over each speed range preferably only one of the steam flows through the turbine 108 and through the turbines 111 and 112 is varied to control the shaft speed, with the above mentioned advantage of simplicity. During acceleration of the A turbine-generator the bypass valve control system 146 regulates the pressure of steam in the hot reheat header 125 according to the reference pressure level specified by the signal on the line 143; such pressure regulation advantageously increases the accuracy with which the shaft speed is controlled, and maintains the desired minimum flow through the reheater sections. Such pressure regulation also promotes maintenance of an effectively constant steam flow through the turbines 111 and 112 at speeds in excess of X rpm.

A difference between speed control arrangement shown in FIG. 6 and the one shown in FIG. 4 is that there is a flow of steam through the turbines 111 and 112 at speeds below X rpm when the A turbine-generator is accelerated under control of the arrangement shown in FIG. 6, while there is no flow through such turbines at speeds below X rpm when acceleration is controlled by the arrangement shown in FIG. 4. A flow through the turbines 111 and 112 desirably warms portions of the turbine 111 and cools turbine portions near the steam exhaust of the turbine 112.

Figure 7:
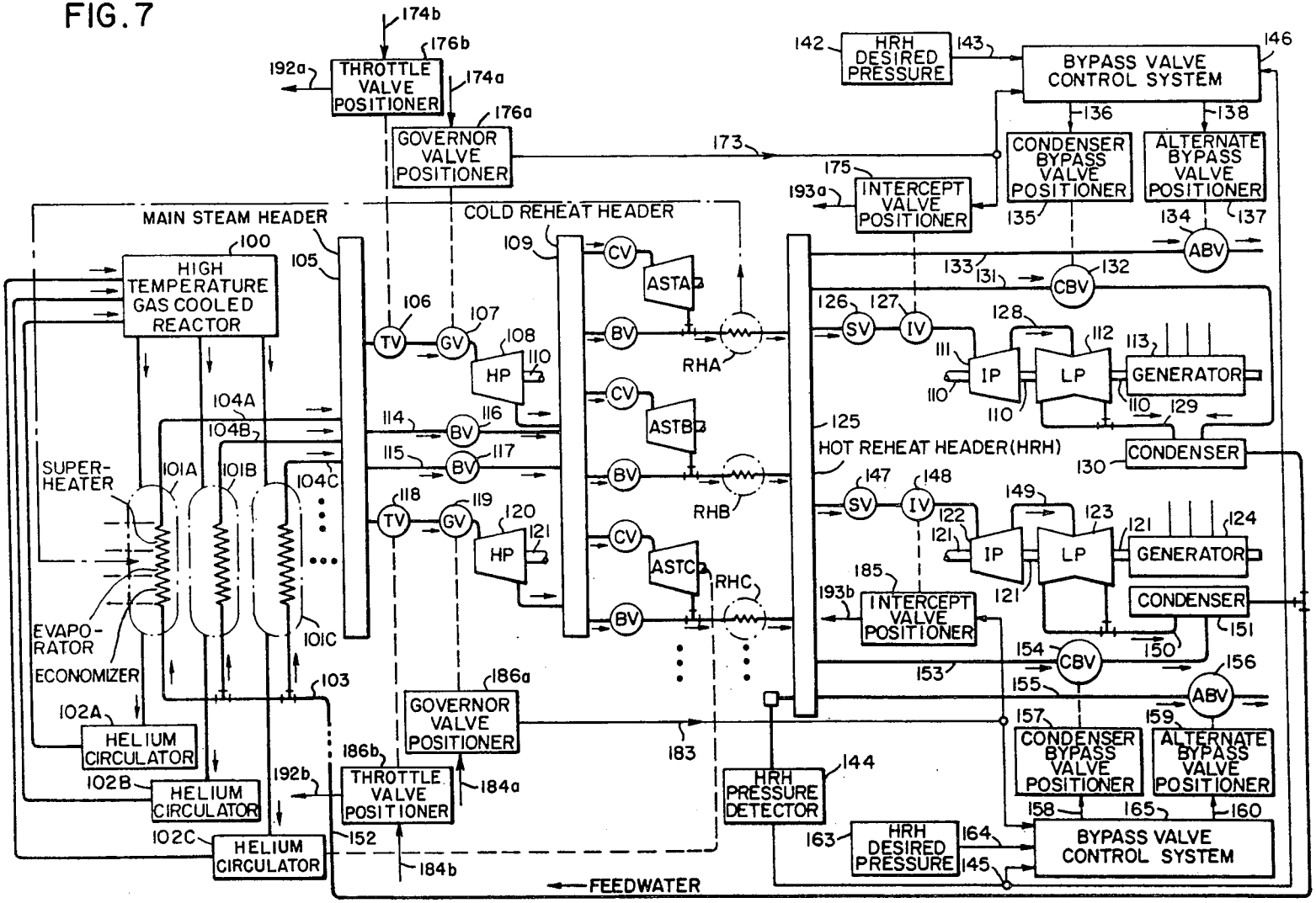
FIG. 7 schematically shows an electric power plant.
Figure 8:
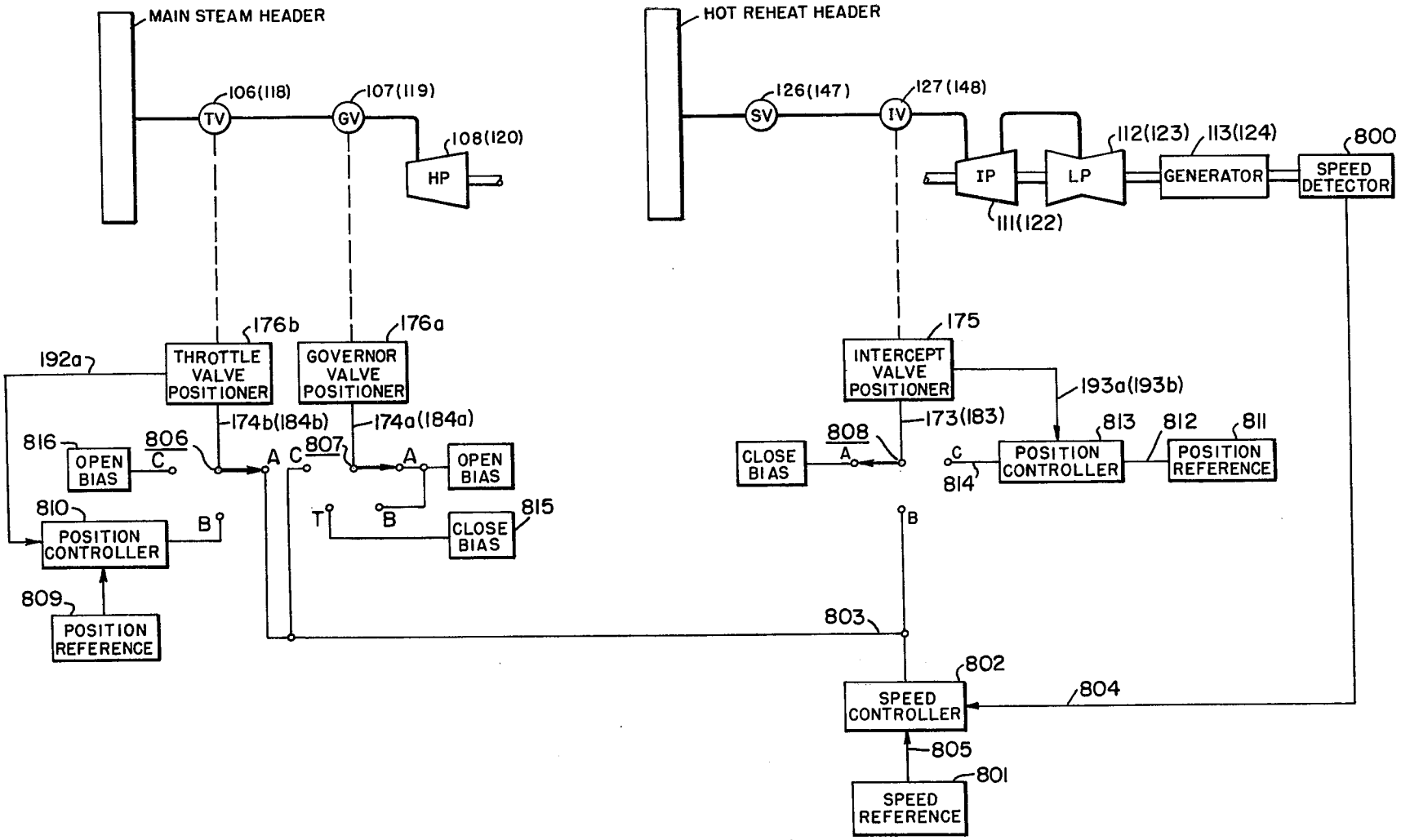
FIG. 8 illustrates an acceleration control system according to the present invention for use in the power plant of FIG. 7.
Figure 9:
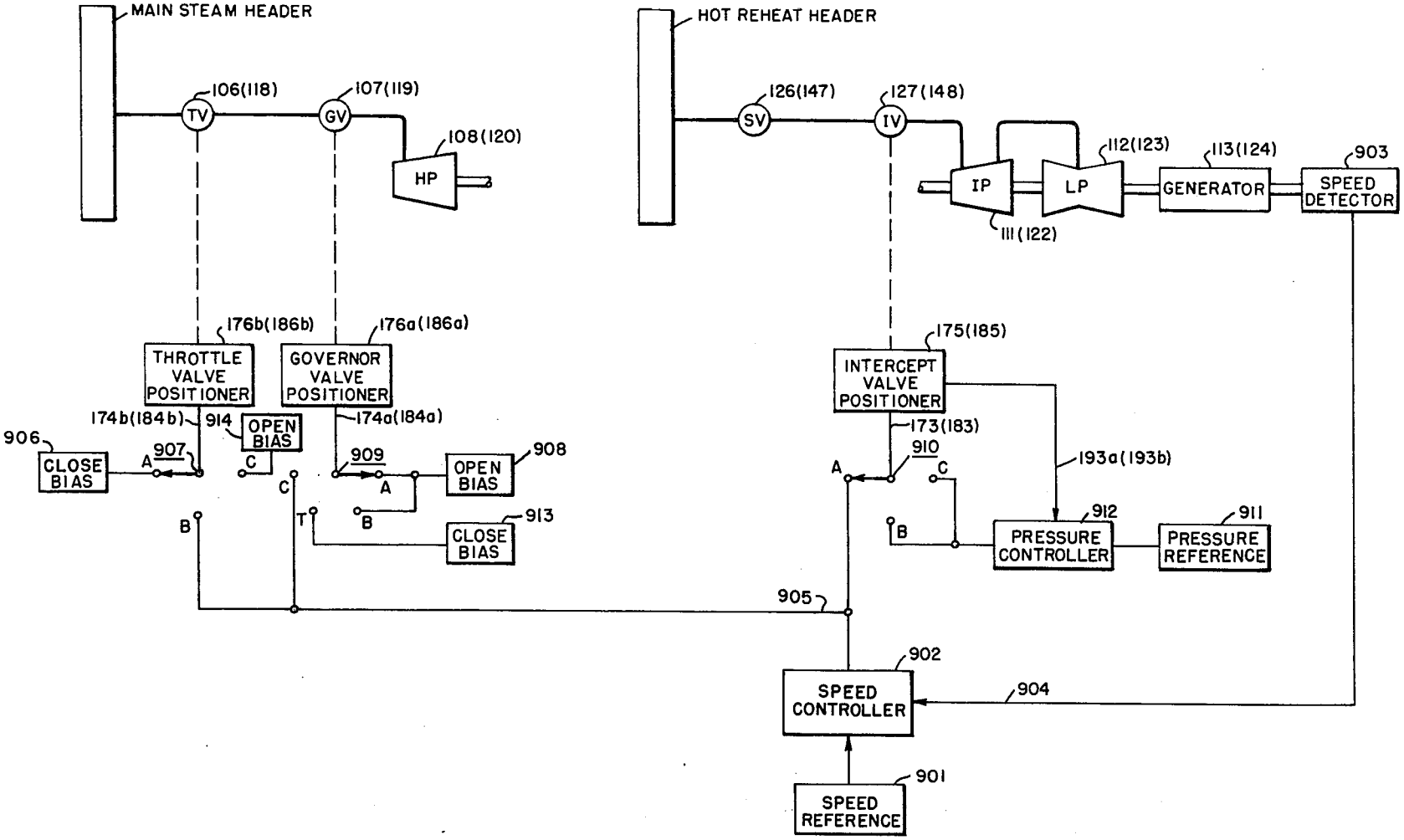
FIG. 9 illustrates another acceleration control system according to the present invention for use in the power plant of FIG. 8.

Referring now to FIG. 7, a dual turbine power plant is shown. Arrangements for controlling the shaft speed of the turbine-generators in FIG. 7 are shown in FIGS. 8 and 9. With the exception of reference numerals 192*a*, 192*b*, 193*a* and 193*b*, the descriptions relating to the reference numerals in FIG. 7 are previously provided with respect to FIG. 1. The throttle valve positioners 176*b* and 184*b* shown in FIG. 7 respectively generate signals on the lines 192*a* and 192*b* which represent the actual positions of the throttle valves. Thus the signal on the line 192*a* represents the position of the throttle valve 106 associated with A turbine-generator, and the signal on the line 192*b* represents the position of the throttle valve 118 that is associated with the B turbine-generator. The intercept valve positioner 175 generates a signal on the line 193*a* representative of the position of the intercept valve 127 which is associated with the A turbine-generator. The intercept valve positioner 185 generates a signal on the line 193*b* representative of the position of the intercept valve 148 which is associated with the B turbine generator.

Referring to FIG. 8, an arrangement is shown for controlling the shaft speed of the A turbine-generator, as detected by a speed detector 800, in accordance with a speed reference signal which is generated by a device 801. A speed controller 802 is responsive to a difference between the reference speed specified by the output signal of the device 801 and the shaft speed detected by the speed detector 800 to generate an output signal on the line 803 which is coupled to the input of one of the valve positioners 175, 176*a* and 176*b*, whereby one of the valves 106, 107 and 127 is positioned to vary the steam flow through its respective turbine portion so that the detected shaft speed is effectively equal to the reference speed valve.

In more detail, the speed detector 800 is connected to detect the shaft speed of the A turbine generator and generates an output signal which represents the detected speed, such signal being conducted by a line 804 to a first input of the speed controller 802. The speed reference signal generator 801 is an adjustable voltage producing device or a digital computer with an analog output, which generates a signal on the line 805 which is connected to a second input of a controller 802, such signal representing a desired or reference speed. The speed controller 802 is responsive to a difference between the signals on the lines 804 and 805 to generate a signal on the line 803; when one of the valves 106, 107 and 127 is positioned in accordance with such signal, the difference is reduced and the detected shaft speed is governed to be effectively equal to the desired shaft speed.

As the signal on the line 805 is increased from a level corresponding to turning gear speed to a level corresponding to X rpm,, a switch 806 in position A couples the output signal of the speed controller 802 to the input of the throttle valve positioner 176*b*. A switch 807 placed in the A position over such speed range couples an open bias signal to the input of the governor valve positioner 176*a* to hold the governor valve 107 fully open. From turning gear speed to X rpm, a switch 808 placed in the A position couples a close bias signal to the input of the intercept valve positioner 175 to hold the intercept valve 127 closed. Thus the throttle valve 106 varies the steam flow through the turbine 108 to govern the detected shaft speed of the A turbine-generator according to the desired shaft speed, at times when the desired speed is increased from turning gear speed to X rpm.

At X rpm, a position reference signal generator 809 is set to generate a position reference that represents the position of the throttle valve 106 at such speed, such position being represented by the signal on the line 192*a*. Both the position reference signal and the line 192*a* are connected to a position controller 810, which generates an output signal in response to a difference between the reference signal and the signal on the line 192*a*. From X and Y rpm, the output signal of the controller 810 is coupled by the switch 806 in the B position to the input of the throttle valve positioned 176*b*. If, for any reason, the position of the throttle valve 106 as represented by the signal on the line 192*a*, deviates from the reference position as specified by the output signal of the device 809, the controller 810 develops an output signal which causes the position of the throttle valve 106 to return to its reference valve. Thus, the throttle valve 106, throughout the speed range X to Y rpm, is held at its position when the shaft speed reached X rpm.

From X to Y rpm, the switch 807 remains in the B position, whereby the governor valve 107 is held fully open. Over such speed range, the switch 808, in position B, couples the output signal of the controller 802 to the input of the intercept valve positioner 175. As the speed reference signal on the line 805 is increased from a level corresponding to X rpm to a level corresponding to Y rpm, the intercept valve 127 is positioned to vary the steam flow through the turbines 111 and 112 to govern the shaft speed of the A turbine-generator according to its reference value.

When the detected shaft speed reaches Y rpm a signal generator 811 is set to generate a position reference signal on a line 812 that represents the position of the intercept valve 127, as represented by the signal on the line 193*a*, at the speed of Y rpm. Both the position reference signal on the line 812 and the signal on the line 193*a* are connected to a position controller 813, which is responsive to a difference between such signals to generate an output signal on a line 814. The switch 808 is placed in position C and remains in such position at speeds from Y rpm to synchronous speed. When there is a difference between the position reference signal on the line 812 and the position of the intercept valve 127, as represented by the signal on the line 193*a*, the intercept valve positioner 175 varies the position of the intercept valve 127 in accordance with the signal on the line 814, to reduce the difference. At speeds from Y rpm to synchronous speed, the detected position of the intercept valve 127 thus is governed in accordance with the detected position of that valve when the shaft speed reached Y rpm.

At Y rpm, the switch 807 is moved to the T position to connect the output of a close bias signal generator 815 the input of the governor valve positioner 176*a*, to ramp the governor valve 107 closed quickly. With the governor valve 107 closed, the switch 806 is placed in the C position to transmit the output signal of an open bias signal generator 816 to the input of the throttle valve positioner 176*b*, to hold the throttle valve 106 fully open. Then the switch 807 is placed in the C position, whereby the governor valve 107 is positioned in accordance with the signal on the line 803. From Y rpm to a synchronous speed, the speed controller 802 positions the governor valve 107 to vary the flow through the turbine 108 to govern the detected shaft speed according to the desired shaft speed represented by the signal on the line 805.

Referring now to FIG. 9 there is shown a system for controlling the detected shaft speed of the A turbine generator shown in FIG. 7, in accordance with a speed reference signal. A device 901, such as an adjustable voltage reference or digital computer with a digital to analog converter, generates an output speed reference signal which is connected to one input of a speed controller 902. A speed detector 903 detects the shaft speed of the A turbine-generator and generates a signal on line 904 that is representative of the detected shaft speed. The line 904 is connected to a second input of the speed controller 902, which is responsive to the difference between the desired and detected speed signals to generate an output signal on a line 905. At any time, the signal on the line 905 is connected to the input of one of the valve positioners 176*a*, 176*b* and 175. When the associated valve is positioned according to the signal on the line 905, the steam flow through the respective turbine portion is varied to reduce the difference between the detected speeds and the desired speeds, and the detected speed thus is governed according to the reference speed value.

At times when the desired shaft speed is less than X rpm, there is no steam flow through the turbine 108 because the throttle valve 106 is closed at such speeds. The throttle valve 106 is held closed by a close bias output signal of a signal generator 906, which output signal is coupled to the input of the throttle valve positioner 176*b* by a switch 907 placed in the a position. The governor valve 107 is held open at such speeds by an open bias output signal of a signal generator 908, the output signal being coupled to the input of the governor valve positioner 176*a* by a switch 909 placed in the A position.

At speeds less than X rpm, the detected shaft speed is controlled by positioning the intercept valve 127 according to the output signal of the speed controller 902 which signal is coupled to the input of the intercept valve positioner 175 by a switch 910 placed in the A position.

At speeds from X rpm synchronous speed, the steam flow through the turbines 111 and 112 is controlled by holding the intercept valve 127 at its position when the detected shaft speed is X rpm and steam passes through the turbines 111 and 112 only. At X rpm, a variable signal generator 911 is set to generate an output signal that represents the position of the intercept valve 127, as represented by the signal on the line 193*a*, at such speed. The output signal of the signal generator 911 remains at the level which represents the position of the intercept valve 127 at X rpm at speeds from X rpm to synchronous speed. The output signal of the signal generator 911 and the signal on the line 913*a* are coupled to first and second inputs of a position controller 912, which is responsive to a difference between the input signals to generate an output signal which is coupled to the input of the intercept valve positioner 175 by the switch 910, when that switch is placed in the B or C positions. If, for any reason, the detected position of the intercept valve 127 varies from the desired position of such valve, as represented by the output signal of the signal generator 911, then the position controller 912 develops an output signal which causes the intercept valve positioner 175 to move the intercept valve 127 to reduce the difference between the input signals of the position controller 912, whereby the position of the valve 127 is governed according to its position at X rpm.

At X rpm, the switch 907 is placed in the B position after the intercept valve 127 is placed under the previously described position control, and the signal on the line 905 is coupled to the input of the throttle positioner 176*b*. Thus, at speeds from X to Y rpm, the throttle valve 106 is positioned in accordance with the output signal of the speed controller 902, to vary the steam flow through the turbine 108 so that the detected shaft speed is governed in accordance with the desired shaft speed, as represented by the output signal of the signal generator 901.

When the detected shaft speed reaches Y rpm, the switch 909 is placed in the T position to introduce the output signal of the signal generator 913 to the input of the governor valve positioner 176*a*, to cause the governor valve 107 to be ramped closed quickly. After the valve 107 is closed, the switch 907 is placed in the C position to transmit the output signal of an open bias signal generator 914 to the input of the throttle valve positioner 176*b*, to open fully the throttle valve 106 and to hold the valve at such position. Then the switch 909 is placed in the C position to couple the output signal of the speed controller 902 to the input of the governor valve positioner 176*a*, whereby the steam flow through the turbine 108 is varied to govern the detected shaft speed in accordance with the desired speed as represented by the output of the signal generator 901, at speeds from Y rpm to synchronous speed.

It is understood that the speed control systems shown in FIGS. 8 and 9 operate in concert with the bypass valve control system 146, which controls the flow of hot reheat steam through the lines 131 and 133 in order to maintain a desired value of the pressure of steam in the hot reheat header, and thereby to maintain a desired minimum steam flow through the reheater sections during acceleration of the A turbine generator to synchronous speed. Thus, steam flow through the bypass lines 131 and 133 is reduced as the stream flow through the turbines 111 and 112 is increased for purposes of accelerating the A turbine-generator.

Although the acceleration control arrangements shown in FIGS. 8 and 9 are described above in relation to the A turbine-generator (see FIG. 7), the descriptions of the arrangements also relate to the B turbine-generator, provided that reference numerals in parentheses in FIGS. 8 and 9 are substituted for their corresponding reference numerals, when the corresponding numerals appear in such descriptions.

In the systems shown in FIG. 8, the intercept valve 127 is placed under position control at speeds in excess of Y rpm, while the throttle valve 107 is placed under such control at intermediate speeds (from X to Y rpm). In the system shown in FIG. 9, the intercept valve 127 is placed under position control at speeds in excess of X rpm. When a valve is under such position control, the flow through its associated turbine portion may vary, due to changes of the turbine portion with temperature that affect steam flow, or due to changes with temperature of the valve or of the apparatus which detects the position of the valve. Such changes of steam flow cause variation of the shaft speed of the respective turbine-generator. It is understood that such variation is detected and that the associated speed controller compensates for such variation by varying that steam flow which is used for purposes of governing the shaft speed at the time that the speed variation occurs.

Each of the various controllers included in the speed control arrangments according to FIGS. 4, 6, 8 and 9 is a PI type controller, that is, one having proportional and integral modes. The output signal of such a controller is the sum of two component signals, one being directly proportional to the difference between the input signals to the controller, and the other being proportional to the time integral of such difference. Each speed detector shown in FIGS. 4, 6, 8 and 9 includes a toothed wheel which is coupled to rotate with the associated turbine shaft. As the wheel rotates the passage of each tooth past an adjacent fixed position causes a pulse, and the detected pulse frequency is converted to an output rpm signal.

For purposes of speed control the arrangements shown in FIGS. 4 and 8 vary the steam flow through the turbine 108 from turning gear speed to X rpm, the flow through the turbines 111 and 112 from the X to Y rpm, and the flow through the turbine 108 from Y rpm to synchronous speed. The arrangements shown in FIGS. 6 and 9 vary the flow through the turbines 111 and 112 from turning gear speed to X rpm, and the flow through the turbine 108 from X rpm to synchronous speed; such arrangements are relatively simpler to build than those of FIGS. 4 and 8, for they require no means for holding the flow through the turbine 108 relatively constant at speeds from X and Y rpm. As the arrangements of FIGS. 6 and 9 permit no steam flow through the turbine 108 at low speeds, it is desirable to connect an isolation valve between the steam exhaust of the turbine 108 and the cold reheat header 109 (see FIG. 1) so that the exhaust end of the turbine 108 is not subjected to windage heating from rotation through high pressure steam.

While the arrangements of FIGS. 8 and 9 hold a constant position of a flow control valve in order to maintain a relatively constant flow of steam through its associated turbine portion, the arrangements of FIGS. 4 and 6 vary the position of the flow control valve in order to maintain a constant steam pressure difference between a point within the associated turbine portion and its steam exhaust, and thus to maintain a substantially constant steam flow through the turbine portion. Thus the flow characteristic of the flow control valve may vary with temperature, but advantageously there is no resulting change of the steam flow through the turbine portion, due to the constant pressure differential. However, in both the arrangements of FIGS. 8 and 9 and those of FIGS. 4 and 6, a positive control action, whether regulation of a valve position or regulation of a pressure differential, is taken to ensure a relatively constant flow of steam through a turbine portion, and thereby to ensure that various parts of the turbine portion are adequately warmed or cooled by the steam flow.

What is claimed is:

1. An electric power plant having a steam generator which includes a superheat section for generating superheat steam, and a reheat section for reheating steam, comprising, a turbine-generator, said turbine-generator comprising a high pressure turbine portion connected to pass a first steam flow from an outlet of the superheat section to an exhaust of said high pressure portion, and a lower pressure turbine portion connected to pass a second steam flow from an outlet of the reheat section to an exhaust of said lower pressure portion, said high and lower pressure turbine portions being shaft coupled to drive an electric generating means, first bypass means connected to conduct steam from the outlet of the superheat section to the exhaust of said high pressure turbine portion, means for conducting steam from the exhaust of said high pressure turbine portion to an inlet of the reheat section, second bypass means connected to conduct steam from the outlet of the reheater section to the exhaust of the lower pressure turbine portion, means for generating a first signal representative of a desired shaft speed of said turbine-generator, means connected to detect the shaft speed of said turbine-generator and to generate a second signal representative of the detected shaft speed, and means for varying one of the first and second steam flows in response to a difference between the first and second signals to reduce such difference whereby the detected shaft speed is controlled according to the desired shaft speed, and for governing at a substantially constant level that one of the first and second steam flows which is not varied for purposes of controlling the shaft speed.

2. A power plant according to claim 1 wherein the steam generator derives heat from the coolant gas of a high temperature gas-cooled nuclear reactor for purposes of generating superheat steam and reheating system.

3. A power plant according to claim 2 wherein said means for conducting steam includes auxiliary turbine means connected to pass at least a portion of the steam flow from the exhaust of the high pressure turbine to the inlet of the reheat section, said turbine means being rotatably coupled to drive a means for circulating the coolant gas through the nuclear reactor and the steam generator.

4. A power plant according to claim 3 further comprising, means for generating a fourth signal representative of a desired value of a predetermined power plant variable that is related to a desired minimum flow of steam through the reheat section, means for detecting the value of the power plant variable that is related to the flow of steam to the reheat section and for generating a fifth signal representative of the detected value, and means responsive to a difference between the fourth and the fifth signals for varying the flow of steam through the second bypass means to reduce the difference, to maintain the desired minimum steam flow through the reheat section.

5. A power plant according to claim 4 wherein the predetermined power plant variable that is related to the flow of steam through the reheat section is the pressure of steam at the outlet of the reheat section.

6. A power plant according to claim 1 wherein the second steam flow is varied and the first flow is held substantially constant at times when the desired shaft speed is less than a first value, and the first steam flow is varied while the second steam flow is held substantially constant when the desired shaft speed exceeds the first value.

7. A power plant according to claim 6 wherein the level of the first steam flow is zero when the desired shaft speed is less than the first value.

8. A power plant according to claim 6 wherein the second steam flow is controlled by an intercept value that is connected between the outlet of the reheat section and the inlet of the lower pressure turbine portion, the second steam flow being held substantially constant by governing the detected position of said intercept value according to the position of that valve when the shaft speed of the turbine-generator is equal to the first value.

9. A power plant according to claim 6 wherein the second steam flow is controlled by an intercept valve that is connected between the outlet of the reheat section and the inlet of the said lower pressure turbine portion, the second steam flow being held substantially constant by varying said intercept valve to govern the pressure of steam at a location within said lower pressure turbine portion according to the value of that pressure when the shaft speed of the turbine-generator is equal to the first value.

10. A power plant according to claim 1 wherein the first steam flow is varied and the second steam flow is governed at a substantially constant level when the desired shaft speed is less than a first value or when the desired shaft speed exceeds a second value that is greater than the first value, and the second steam flow is varied while the first steam flow if governed at a substantially constant level when the desired shaft speed lies between the first and the second values.

11. A power plant according to claim 10 wherein the level of the second steam flow is zero when the desired shaft speed is less than the first value.

12. A power plant according to claim 10 wherein the first flow is controlled at least by a throttle valve connected between the outlet of the superheat section and an inlet of said high pressure turbine portion, and the second flow is controlled by an intercept valve connected between the outlet of the reheat section and the inlet of said lower pressure turbine portion, the first flow being held substantially constant by governing the position of the throttle valve according to the position of that valve when the shaft speed is equal to the first value, the second flow being held substantially constant by governing the position of the intercept value according to the position of that valve when the shaft speed is equal to the second value.

13. A power plant according to claim 10 wherein the first flow is controlled at least by a throttle valve connected between the outlet of the superheat section and the inlet of said high pressure turbine portion, and the second flow is controlled by an intercept valve connected between the outlet of the reheat section and the inlet of said lower pressure turbine portion, the first flow being held substantially constant by positioning the throttle valve to govern the difference of steam pressure between a location within said high pressure turbine portion and the exhaust of such portion according to the value of that difference when the shaft speed is equal to the first value, the second flow being held substantially constant by positioning the intercept valve to govern the pressure of steam at a location within said lower pressure portion according to the value of that pressure when the shaft speed is equal to the second value.

14. An acceleration control system for the turbine-generator which includes a high pressure turbine portion, first valve means connected to control a first steam flow through the first valve means and the high pressure turbine portion in succession, from a steam inlet of the first valve means to a steam exhaust of the high pressure turbine portion, and first bypass means connected to pass a first bypass steam flow from the steam inlet of the first valve means to the steam exhaust of the high pressure turbine portion, a lower pressure turbine portion, second valve means connected to control a second steam flow through the second valve means and the lower pressure turbine portion in succession, from a steam inlet of the second valve means to a steam exhaust of the lower pressure turbine portion, and secone bypass means connected to pass a second bypass steam flow from the steam inlet of the second valve means to the steam exhaust of the lower pressure turbine portion, means for conducting a third steam flow from the exhaust of the high pressure turbine portion to the inlet of the second valve means, and electric generating means having a shaft that is rotated by the high and lower pressure turbine portions, said system comprising, means for detecting the shaft speed of the turbine generator and for generating a first signal representative of the detected speed, means for generating a second signal representative of a desired shaft speed of the turbine generator, and means for positioning the first and second valve means to govern the first and second steam flows, said positioning means being responsive to a difference between the first and second signals to vary one of the first and second steam flows to reduce the difference, whereby the detected shaft speed is controlled according to the desired shaft speed, that one of the first and second steam flows which is not varied for purposes of controlling the shaft speed being held substantially constant.

15. A control system according to claim 14 wherein the means for conducting the third steam flow includes means for reheating the flow.

16. A control system according to claim 15 wheren said reheating means transfers heat from the coolant gas of a high temperature gass-cooled nuclear reactor to the third steam flow, such coolant gas being circulated through the reactor and the reheating means.

17. A control system according to claim 16 wherein at least a portion of the third steam flow passes through an auxiliary steam turbine means which is rotatably coupled to drive a means for circulating the coolant gas.

18. A control system according to claim 15 further comprising, means for generating a third signal representative of a desired value of a predetermined variable that is related to the third steam flow, means for detecting the value of the predetermined variable and for generating a fourth signal representative of the detected value, and means responsive to a difference between the third and the fourth signals for varying the second bypass steam flow to reduce the difference, whereby the detected value is controlled in accordance with the desired value.

19. A control system according to claim 18 wherein the third signal represents a desired value that corresponds to a desired minimum level of the third steam flow.

20. A control system according to claim 18 wherein the predetermined variable is the pressure of steam at the steam inlet of the second valve means.

21. A control system according to claim 14 wherein the second steam flow is varied to control the shaft speed when the desired speed is less than a first value, and the first steam flow is varied to control the shaft speed when the desired speed exceeds the first value.

22. A control system according to claim 21 wherein the first valve means includes a throttle valve means and a governor valve means in series connection, the throttle valve means being positioned to control the shaft speed when the desired speed exceeds the value and is less than a second value that is greater than the first value, the governor valve means being positioned to control the shaft speed when the desired speed exceeds the second value.

23. A control system according to claim 21 wherein the first steam flow is zero when the desired shaft speed is less than the first value.

24. A control system according to claim 14 wherein the first steam flow is varied to control the shaft speed at times when the desired speed is less than a first value or greater than a second value that exceeds the first value, and the second steam flow is varied to control the shaft speed when the desired speed lies between the first and the second values.

25. A control system according to claim 24 wherein the second steam flow is zero at times when the desired shaft speed is less than the first value.

26. A control system according to claim 24 wherein the first valve means includes a throttle valve means and a governor valve means in series connection, the throttle valve means being positioned to control the shaft speed when the desired speed is less than the first value, the governor valve means being positioned to control the shaft speed when the desired speed exceeds the second value.

* * * * *